United States Patent [19]

Wait

[11] 4,285,438

[45] Aug. 25, 1981

[54] PALLET BOX

[75] Inventor: Hershey Wait, Lake Zurich, Ill.

[73] Assignee: General Box Company, Elk Grove, Ill.

[21] Appl. No.: 90,537

[22] Filed: Nov. 2, 1979

[51] Int. Cl.[3] ..... B65D 6/24

[52] U.S. Cl. ..... 217/43 A; 217/12 R; 217/65

[58] Field of Search ..... 217/65, 69, 43 R, 43 A, 217/12 R; 108/56.1, 56.3, 51.1; 206/386, 600

[56] References Cited

U.S. PATENT DOCUMENTS

| | | | |
|---|---|---|---|
| 732,507 | 6/1903 | Blackstone | 217/4 X |
| 910,792 | 1/1909 | Dahl | 217/43 R X |
| 1,325,493 | 12/1919 | Kenniker | 217/43 R X |
| 2,502,781 | 4/1950 | Erickson | 270/70 X |
| 2,738,092 | 3/1956 | Ledd | 217/43 A |
| 3,027,038 | 3/1962 | Kordowski | 217/43 A |
| 3,323,674 | 6/1967 | Nist, Jr. | 217/65 X |

FOREIGN PATENT DOCUMENTS

| | | | |
|---|---|---|---|
| 847036 | 9/1960 | United Kingdom | 108/56.1 |

*Primary Examiner*—Allan N. Shoap
*Attorney, Agent, or Firm*—Richard D. Emch

[57] ABSTRACT

A pallet box having a floor assembly which can be connected to the side wall assemblies without the use of nails is disclosed. The pallet box includes a plurality of side wall assemblies joined at their adjacent vertical edges to form an enclosure. Cleats are mounted adjacent the lower edges of the side wall assemblies and define bearing recesses. A bottom support assembly has finger members extending outwardly, which are received by the cleat recesses. The floor assembly is positioned on and is supported by the cleats and the bottom support assembly.

14 Claims, 5 Drawing Figures

FIG. 3
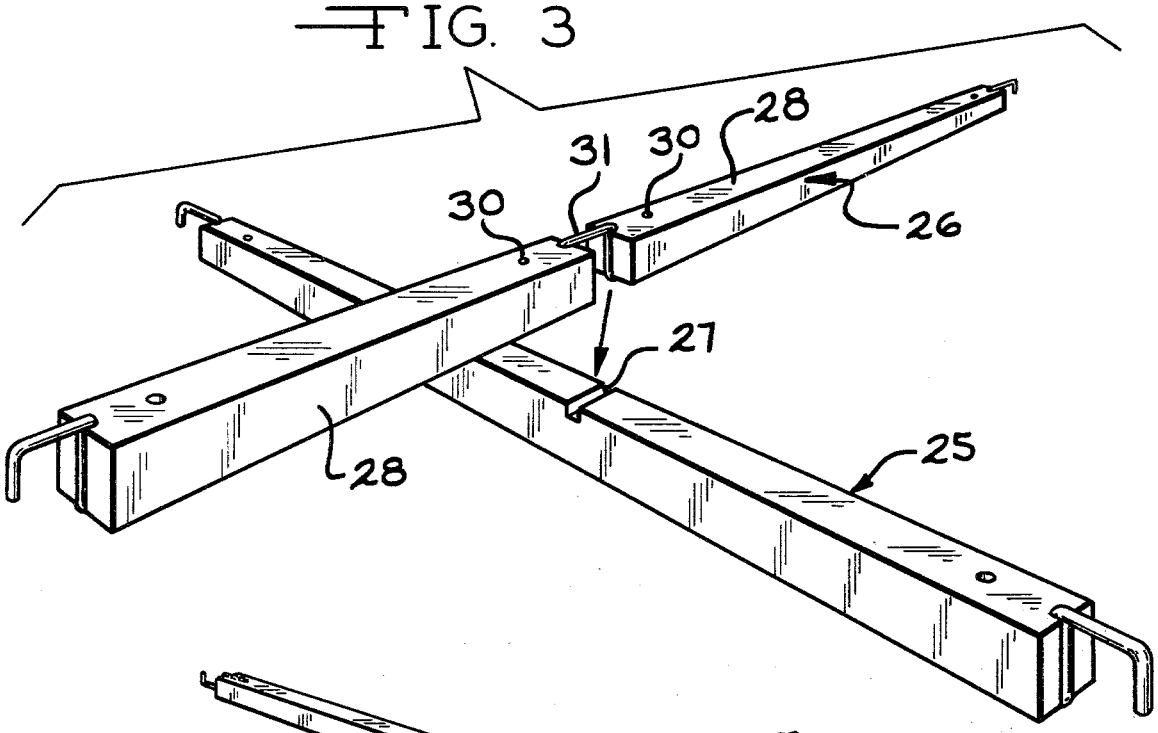
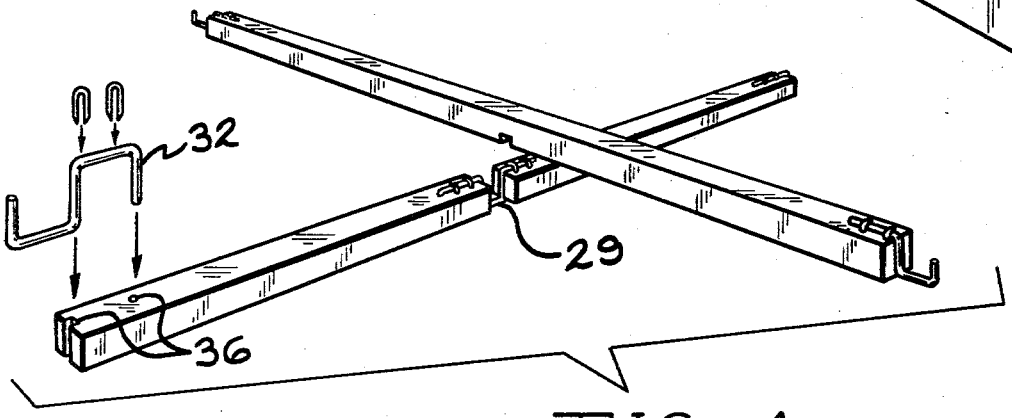
FIG. 4
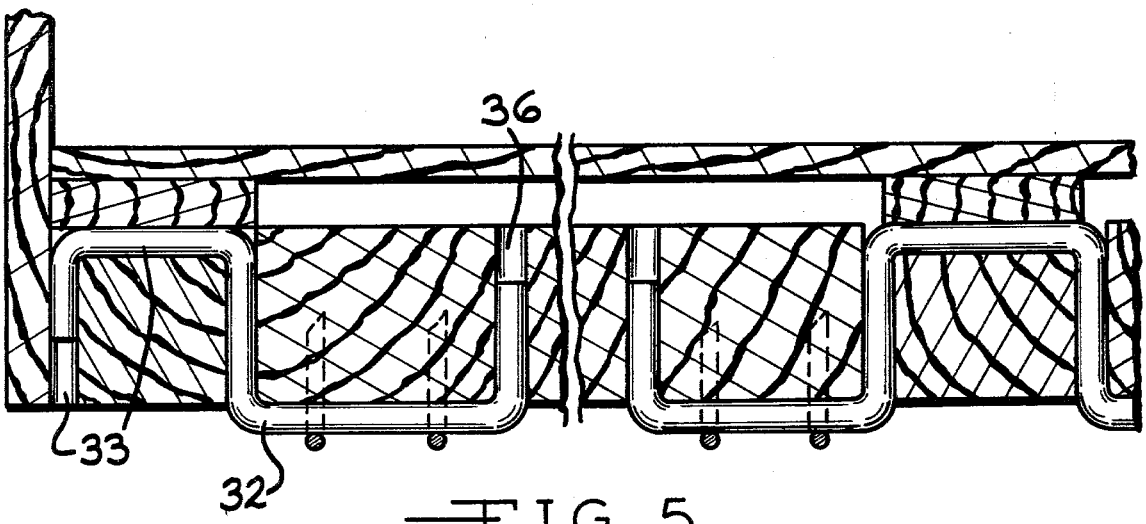
FIG. 5

PALLET BOX

SUMMARY OF THE INVENTION

This invention is generally directed to pallet boxes, and particularly to an improved pallet box which can be finally assembled without the use of nails.

The pallet box of the present invention comprehends four side-assemblies joined at their adjacent vertical edges to form a four-sided enclosure. Fixed to the interior of the four-sided enclosure is a top cleat or liner assembly and a bottom cleat or liner assembly which serve to strengthen the side walls. The side walls are generally constructed of a plurality of slats joined at their adjacent vertical edges. In the preferred embodiment the slats are of unequal length. The two opposed slats defining the vertical edges of each side assembly and the slat defining the center line of each side assembly are of a length greater than the remaining slats. The extra length of these three slats extends below the remaining slats of each side assembly to form posts which act to support the pallet box.

A bottom support assembly is interlocked with the bottom cleat or liner assembly. The bottom support assembly is composed of two cross-members of equal length fixed together at right angles. The first cross-member is notched to receive the second cross-member. The second cross-member is composed of two half-members, the adjacent ends of which are spaced apart by a width equal to the width of the first cross-member. The spaced adjacent ends are linked together by means of a rod which is bent to engage with the notch of the first cross-member, thereby allowing the second cross-member and the first cross-member to interlock in a flush right-angled position.

At the opposed ends of each cross-member are S-shaped finger members. One half of the S-shaped finger members is fixed in corresponding indents located in the opposed ends of the cross-members. The other half of the S-shaped finger members is then engaged with corresponding bearing recesses located in the bottom liner assembly at the inside perimeter of the four-sided enclosure. The floor assembly is positioned on and supported by the interlocked bottom liner assembly and the bottom support assembly.

It is the primary object of this invention to provide an improved pallet box which can be finally assembled without the use of nails.

Another object of this invention is to provide an improved pallet box which can be disassembled without difficulty.

BRIEF DESCRIPTION OF THE DRAWINGS

FIG. 3 is an exploded detailed view of the bottom support assembly;

FIG. 4 is an exploded view of the bottom of the bottom support assembly; and

FIG. 5 is a fragmentary cross-section view taken along line 5—5 of FIG. 2, with the floor assembly in position.

DESCRIPTION OF THE PREFERRED EMBODIMENT

Figure 1:
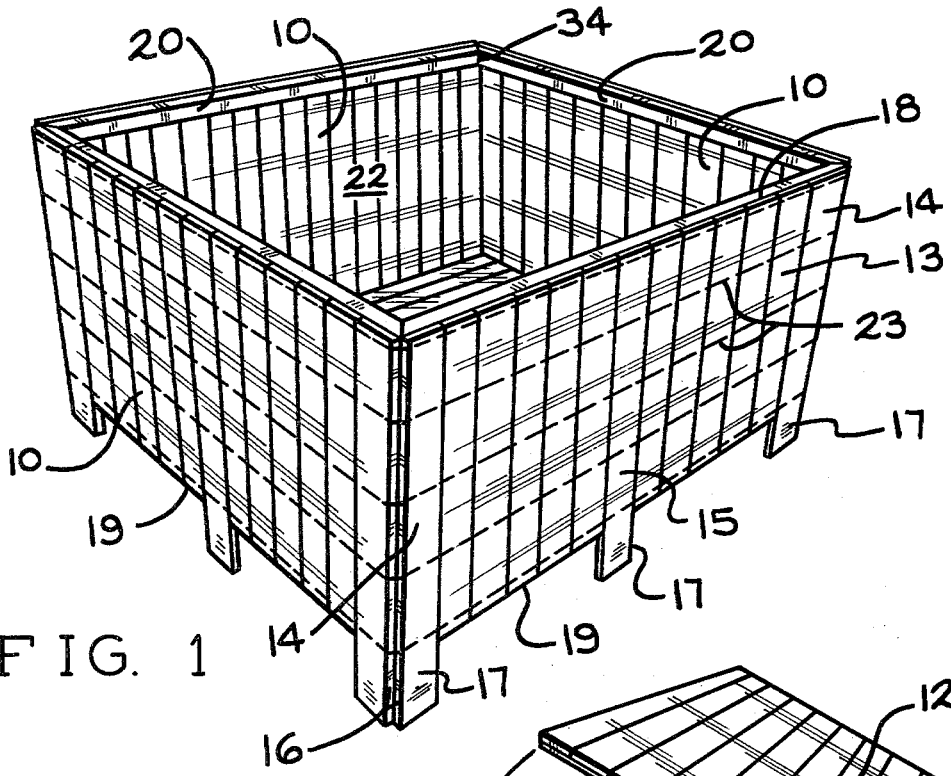
FIG. 1 is a perspective view of the improved pallet box in accordance with the present invention.
Figure 2:
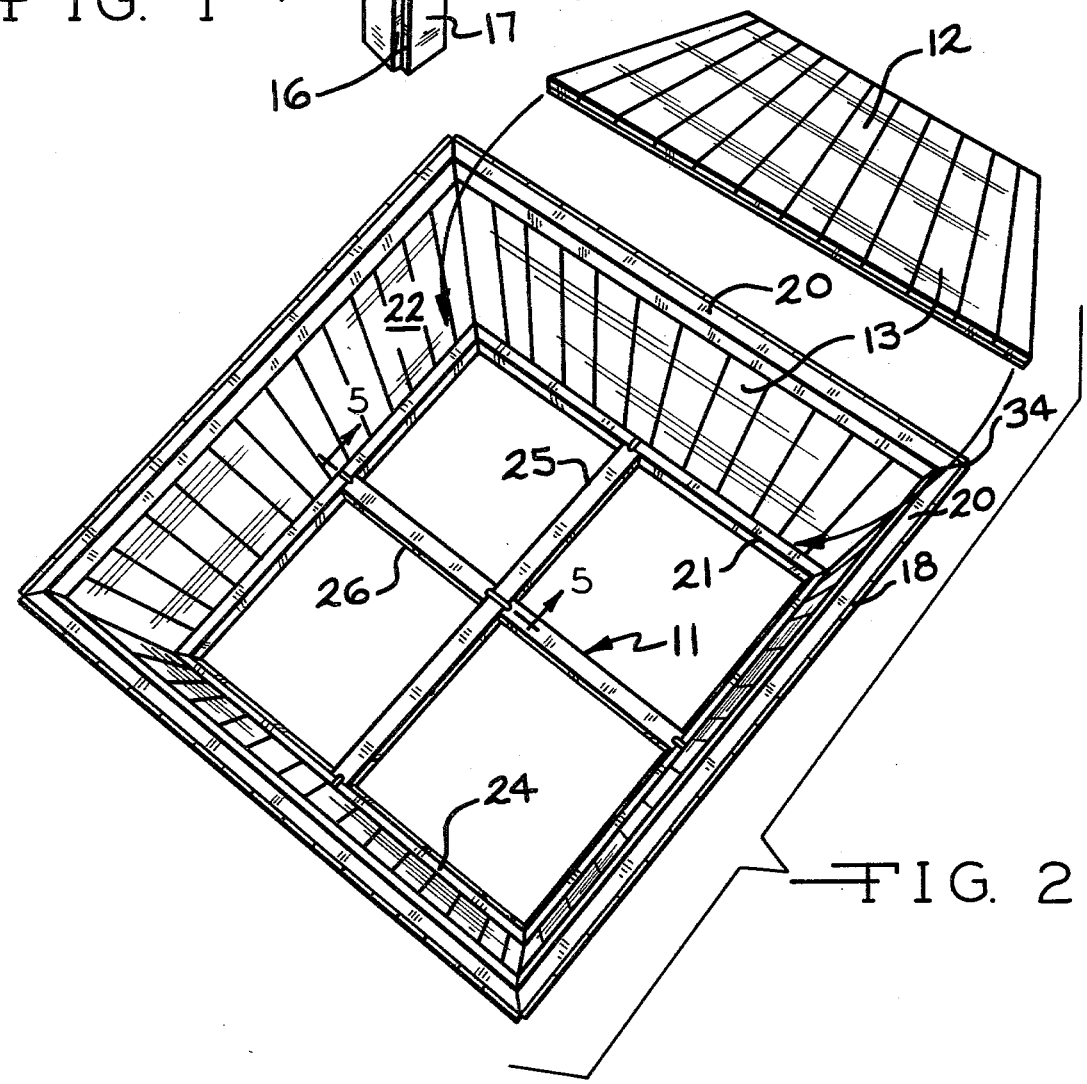
FIG. 2 is a perspective view showing the bottom support assembly engaging the bottom liner assembly in accordance with the present invention.

The improved pallet box of the present invention comprehends a four-sided enclosure 22 having four side assemblies 10, a bottom support assembly 11 and a floor assembly 12. The side assemblies 10, the bottom support assembly 11 and the floor assembly 12 are intended to be assembled into an improved pallet box without the use of nails.

In the preferred embodiment, the side assemblies 10 are constructed from a plurality of slats 13. The slats 13 are of an unequal length, with the end slats 14 or those slats which define the vertical edges 16 of each side assembly 10 being of a length greater than the remaining slats 13. The center slat 15 is of a length equal to the end slats 14. The longer length of the end slats 14 and the center slats 15 allow the end slats 14 and the center slats 15 to act as posts 17 upon which the improved pallet box is supported.

In the present embodiment, the slats 13 of each side assembly 10 are joined together at their upper edges 18 and their bottom edges 19 by means of top cleats or liners 20 and bottom cleats or liners 21. The ends 34 of the liners 20 and bottom liners 21 are beveled to smoothly butt against each other as said side assemblies 10 are joined to form the four-sided enclosure 22.

In the preferred embodiment, the four-sided enclosure 22 formed by the side assemblies 10 joined together at their adjacent vertical edges 16 is strengthened by a wire binding 23 which is wrapped around the exterior of the four-sided enclosure 22.

The bottom support assembly 11 in the interior of the four-sided enclosure 22 interlocks the bottom liner assembly 24. The bottom support assembly 11 is constructed of a first cross-member 25 and a second cross-member 26. The first cross-member 25 defines a notch 27 which receives the second cross-member 26. The second cross-member 26 is composed of two half-members 28 joined together by a rod 29. The two half-members 28 are spaced the width of the first cross-member 25 and the rod 29 is sized to fit the notch 27 in the first cross-member 25. The rod 29 is bent to engage indents 30 found in the adjacent spaced ends of the two half-members 28, thus interlocking the two half-members 28 firmly together, thereby forming the second cross-member 26. An exposed portion 31 of the rod 29 engages the notch 27 of the first cross-member 25 and allows the first cross-member 25 to fill the space between two half-members 28 so that the bottom support assembly 11 becomes one flush structural unit.

At the opposed ends of the first cross-member 25 and the second cross-member 26 are S-shaped finger members 32. One half of each S-shaped finger member is fixed in corresponding indents 36 located at the opposed ends of each cross-member 25 and 26. The remaining one-half of the S-shape finger members 32 are then interlocked into corresponding bearing recesses 33 defined by the bottom liners 21. When fully engaged, the S-shaped finger members 32 firmly interlock the bottom support assembly 11 with the side assemblies 10, thereby giving support for the floor assembly 12. The floor assembly 12 is positioned on and supported by the bottom liners 21 and the bottom support assembly 11.

The bottom support assemby 11 and the floor assembly 12 can be assembled with said side wall assemblies 10 without the use of nails.

In some embodiments, the side wall assemblies 10 are hinged to one another and are shipped flat to the location where the pallet boxes are loaded. The present invention provides an improved pallet box which may be easily assembled and disassembled.

It will be appreciated that other arrangements of the improved pallet box may be used in that other changes may be made in the varying assemblies without departing from the scope of the appended claims.

What I claim is:

1. A pallet box comprising, in combination, a plurality of side wall assemblies joined at their adjacent vertical edges to form an enclosure, a bottom liner assembly comprising cleats mounted adjacent the lower perimeter edges of said joined side wall assemblies, said cleats defining a plurality of bearing recesses, a bottom support assembly having finger members extending outwardly therefrom, said finger members being received by said bearing recesses defined by said cleats, and a floor assembly positioned on and supported by said cleats and said bottom support assembly, whereby said bottom support assembly and said floor assembly can be assembled with said side wall assemblies without the use of nails.

2. A pallet box as described in claim 1 wherein said side assemblies are joined at their adjacent vertical edges by means of wire binding.

3. A pallet box as described in claim 1 wherein said side assemblies are hinged at their adjacent vertical edges.

4. A pallet box as described in claim 1 wherein there are four side assemblies joined at their adjacent vertical edges to form a four sided enclosure.

5. A pallet box as described in claim 1 wherein said side assemblies are comprised of slats joined at their adjacent vertical edges.

6. A pallet box as defined in claim 5 wherein said slats of said side assemblies are of unequal length, the two opposed end slats defining the vertical edges of said side assemblies and the slat defining the center line of said side assemblies being of a length greater than the remaining slats of said side assemblies, said opposed end slats and said center-line slat extending below said remaining slats of said side assemblies to form posts for support of said pallet box.

7. A pallet box as defined in claim 1 wherein said floor assembly is comprised of slats.

8. A pallet box as defined in claim 1 wherein said bottom support assembly is comprised of first and second cross-members, said first and second cross-members intersecting one another, the outer ends of each of said first and second cross-members mounting said finger members, said finger members engaging the corresponding bearing recesses defined by said cleats of said bottom liner assembly whereby said first and second cross-members define a flush support for said floor assembly.

9. A pallet box as defined in claim 8, wherein said first cross-member of said bottom support assembly is notched to receive said second cross-member, said second cross-member including two opposed half-members, the adjacent ends of said two half-members spaced the width of said first cross-member and means for interlocking said two half-members together with said first cross-member.

10. A pallet box, as defined in claim 9, wherein said means for interlocking comprises a rod fixed between said two opposed half-members at the adjacent ends, said rod engaging said notch of said first cross-member.

11. A pallet box, as defined in claim 10, wherein said rod is bent to place said two half-members flush with said first cross-member.

12. A pallet box as defined in claim 1, wherein said finger members are generally S-shaped having an outer hook portion, wherein said bearing recesses define a series of indents to receive such outer hook portion, thereby interlocking said bottom support assembly with said bottom liner assembly.

13. A pallet box comprising, in combination, four side assemblies joined together at their adjacent vertical edges and defining a four-sided enclosure having an interior and an exterior, a top liner assembly comprising upper horizontal cleats mounted adjacent the upper perimeter of said interior of said four-sided enclosure, a bottom liner assembly comprising lower horizontal cleats mounted adjacent the lower perimeter of said interior of said four-sided enclosure, said lower horizontal cleats defining a plurality of bearing recesses, a bottom support assembly having finger members extending outwardly therefrom and received by said bearing recesses defined by said lower horizontal cleats, said bottom support assembly including intersecting first and second cross-members having a flush upper surface, said finger members being mounted on the outer most ends of said first and second cross-members, and a floor assembly to engage with and be supported by said lower horizontal cleats and said flush upper surface of said bottom support assembly, wherein said pallet box can be assembled from said four side assemblies, said bottom support assembly, and said floor assembly without the use of nails.

14. A pallet box comprising, in combination, four side assemblies, said side assemblies including a plurality of slats joined together at their adjacent vertical edges, a top liner comprising horizontally extending upper cleats mounted to said joined slats adjacent the upper edges of each of said side assemblies, a bottom liner comprising horizontally extending lower cleats mounted to said joined slats adjacent the lower edges each of said side assemblies, said side assemblies being joined together at their adjacent vertical edges to form a four-sided enclosure, said lower cleats defining a plurality of bearing recesses, a bottom support assembly having finger members extending outwardly therefrom and received by said bearing recesses, said bottom support assembly comprised of a first cross-member and second cross-member intersecting said first cross-member at right angles, said second cross-member including two opposed half-members, the adjacent ends of said two half-members spaced the width of said first cross-member and interlocked by means of a rod fixed between said two opposed half-members at said adjacent ends, said rod being bent to place the upper surface of said half-members flush with the upper surface of said first cross-member, said finger members extending outwardly from the outer ends of said first and second cross-members defining an S-shape, wherein said bearing recesses define a series of indents to engage one-half of said S-shape and said outer ends of said first and second cross-members define a series of indents to engage the other half of said S-shape, thereby interlocking said bottom support assembly with said bottom liner assembly, and a floor assembly positioned on and supported by said lower cleats of said bottom liner assembly and said bottom support assembly, whereby said bottom support assembly and said floor assembly can be assembled with said side wall assemblies without the use of nails.

* * * * *